US010206466B2

(12) United States Patent
Duhon

(10) Patent No.: US 10,206,466 B2
(45) Date of Patent: Feb. 19, 2019

(54) UMBRELLA SHAFT ASSEMBLY

(71) Applicant: Ronald Duhon, Barberton, OH (US)

(72) Inventor: Ronald Duhon, Barberton, OH (US)

( * ) Notice: Subject to any disclaimer, the term of this patent is extended or adjusted under 35 U.S.C. 154(b) by 0 days.

(21) Appl. No.: 15/611,903

(22) Filed: Jun. 2, 2017

(65) Prior Publication Data

US 2017/0265609 A1 Sep. 21, 2017

Related U.S. Application Data

(63) Continuation of application No. 14/840,536, filed on Aug. 31, 2015, now Pat. No. 9,713,367.

(60) Provisional application No. 62/044,619, filed on Sep. 2, 2014.

(51) Int. Cl.

| | |
|---|---|
| ***A45B 9/00*** | (2006.01) |
| ***A45B 11/00*** | (2006.01) |
| *A45B 23/00* | (2006.01) |

(52) U.S. Cl.

CPC ..... *A45B 9/00* (2013.01); *A45B 11/00* (2013.01); *A45B 2009/005* (2013.01); *A45B 2023/0012* (2013.01); *A45B 2200/1063* (2013.01)

(58) Field of Classification Search

CPC ..... E04H 12/2269; E04H 12/22; A45B 9/00; A45B 23/00; A45B 2023/0012

USPC ..... 248/519, 523

See application file for complete search history.

(56) References Cited

U.S. PATENT DOCUMENTS

| | | | | |
|---|---|---|---|---|
| 2,845,244 | A * | 7/1958 | Prokop | F16M 11/16 160/24 |
| 2,988,310 | A | 6/1961 | Beverly | |
| 3,841,594 | A * | 10/1974 | Zinn | G03B 21/58 160/24 |
| 5,297,570 | A * | 3/1994 | Conner | A45B 11/00 135/16 |
| 5,884,645 | A * | 3/1999 | Chen | A45B 19/04 135/25.1 |
| 6,397,865 | B1 | 6/2002 | Wilson et al. | |
| 6,964,277 | B2 | 11/2005 | Naber | |
| 7,007,703 | B2 | 3/2006 | Brooks | |
| 8,272,605 | B2 * | 9/2012 | Fuchs | F16B 7/1454 248/122.1 |
| 8,656,937 | B1 | 2/2014 | Minasi et al. | |

* cited by examiner

*Primary Examiner* — Noah Chandler Hawk

(74) *Attorney, Agent, or Firm* — Global Intellectual Property Agency, LLC; Daniel Boudwin

(57) ABSTRACT

An umbrella shaft assembly is provided for securing an umbrella to a chair or table. The umbrella shaft assembly includes an elongated shaft having a first end and a second end. A plurality of hinged finger projections are located on the elongated shaft. The finger projections are configured to extend outward and retract inward toward the elongated shaft. Further, an aperture is located on the elongated shaft, wherein a cord extends therethrough. The umbrella shaft assembly can be secured to a chair via securing the cord to a chair frame. Similarly, the umbrella shaft assembly can be secured to a table by extending the finger projections such that the umbrella cannot be hoisted through an umbrella receiving opening of the table. The umbrella shaft assembly further includes a conventional umbrella assembly construction that is large enough to shield a person or persons from the elements encountered outdoors.

11 Claims, 6 Drawing Sheets

UMBRELLA SHAFT ASSEMBLY

CROSS REFERENCE TO RELATED APPLICATION

This application claims priority from and is a continuation of co-pending U.S. patent application Ser. No. 14/840,536 filed on Aug. 31, 2015, which claims the benefit of U.S. Provisional Application No. 62/044,619 filed on Sep. 2, 2014. The above identified patent applications are herein incorporated by reference in their entirety to provide continuity of disclosure.

BACKGROUND OF THE INVENTION

The present invention relates to an umbrella shaft assembly. More particularly, the present invention relates to an umbrella shaft assembly comprising an elongated shaft including a slidable assembly having a plurality of hinged finger projections configured to prevent the umbrella shaft from moving up and out of a table within an umbrella-receiving opening thereof.

People enjoy spending time outdoors and umbrellas allow them to do so without the discomfort of rain or direct sun rays. However, without an anchor or attachment, an umbrella is likely to be blown away by the wind. Not only is it inconvenient to have to constantly chase after a dislodged umbrella, but once the umbrella is swept away from its base, it becomes a dangerous projectile. This is especially a danger at outdoor cafes or on beaches, where many people and umbrellas are located.

When people enjoy the outdoors, such as by having a picnic in the countryside or going to the seashore, they often take with them an outdoor umbrella to provide a retreat and shade from the sun's rays. Outdoor umbrellas generally consist of a retractable umbrella top attached to a post. In order to insert the post into the ground, one must grip the post and rely on arm strength to forcefully insert the post into the earth. Typical ground conditions for such an outdoor activity may include sand at a beach, lawn in a backyard, or other soil conditions at other picnic locations. These ground conditions are sometimes dense, thereby requiring a great deal of arm strength and effort to obtain insertion of the post into the ground. In very compact ground conditions, only a shallow insertion can be achieved.

Alternatively, the user may carry with them a shovel or other digging device to create a hole in the ground and then fill the hole back in once the umbrella is inserted. A shallow insertion of the post into the ground creates the risk that the umbrella may tip over under its own weight. Additionally, breezy conditions or a sudden gust of wind can cause the umbrella to be ripped out of the ground and strike a person, as well as causing the inconvenience of having to chase the umbrella down. Furthermore, the shovel solution only adds to the amount and weight of baggage a person must transport with them on their excursion. Therefore, there exists a need in the prior art for an umbrella shaft assembly that can be conveniently secured to a table or chair that does not add additional weight or burden to a user.

It is therefore submitted that the present invention is substantially divergent in design elements from the prior art, and consequently it is clear that there is a need in the art for an improvement to umbrella shaft assemblies. In this regard, the instant invention substantially fulfills these needs.

SUMMARY OF THE INVENTION

In view of the foregoing disadvantages inherent in the known types of umbrella shaft assemblies now present in the prior art, the present invention provides a new and improved umbrella shaft assembly wherein the same can be utilized for providing convenience for the user when preventing an umbrella shaft from dislodging from a table or similar device.

It is therefore an object of the invention to provide a new and improved umbrella shaft assembly that has all of the advantages of the prior art and none of the disadvantages.

It is an object of the present invention to provide an umbrella shaft assembly for securing an umbrella in place comprising an elongated shaft having a first end and a second end, wherein the elongated shaft comprises a securing mechanism thereon to prevent the shaft from being blown away.

It is another object of the present invention to provide an umbrella shaft assembly comprising a plurality of hinged finger projections disposed on the elongated shaft, wherein the finger projections are configured to extend outward and retract inward toward the elongated shaft.

It is yet another object of the present invention to provide an umbrella shaft assembly including an aperture located on the first end of the elongated shaft, wherein a cord extends therethrough. The cord may be a bungee cord configured to extend through the aperture so as to secure the shaft to another object. The umbrella shaft assembly can be secured to a chair by securing the cord to a chair frame.

Yet another object of the present invention is to provide an umbrella shaft assembly that can be secured to a table by extending the finger projections such that the umbrella cannot be hoisted through an umbrella receiving slot of the table. The elongated shaft can be inserted in an umbrella receiving slot of a table and the finger projections can be subsequently extended such that the shaft is secured to the table.

Still yet another object of the present invention is to provide a new and improved umbrella shaft assembly wherein the device may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
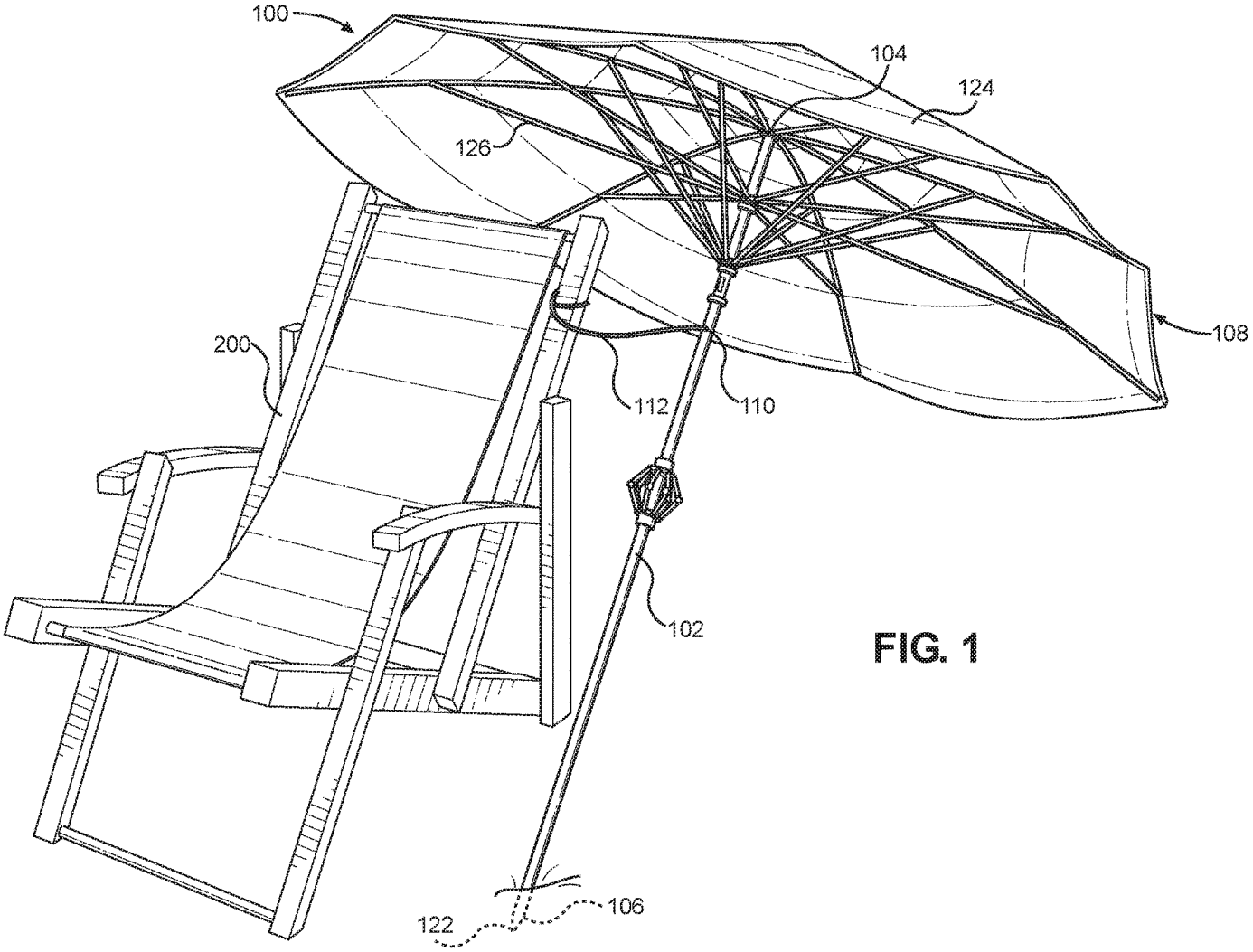
FIG. 1 shows a perspective view of the umbrella shaft assembly secured to a chair.

Reference is made herein to the attached drawings. Like reference numerals are used throughout the drawings to depict like or similar elements of the umbrella shaft assembly. For the purposes of presenting a brief and clear description of the present invention, the preferred embodiment will be discussed as used for securing an umbrella to a table or a chair via securing means. The figures are intended for representative purposes only and should not be considered to be limiting in any respect.

Figure 2A:
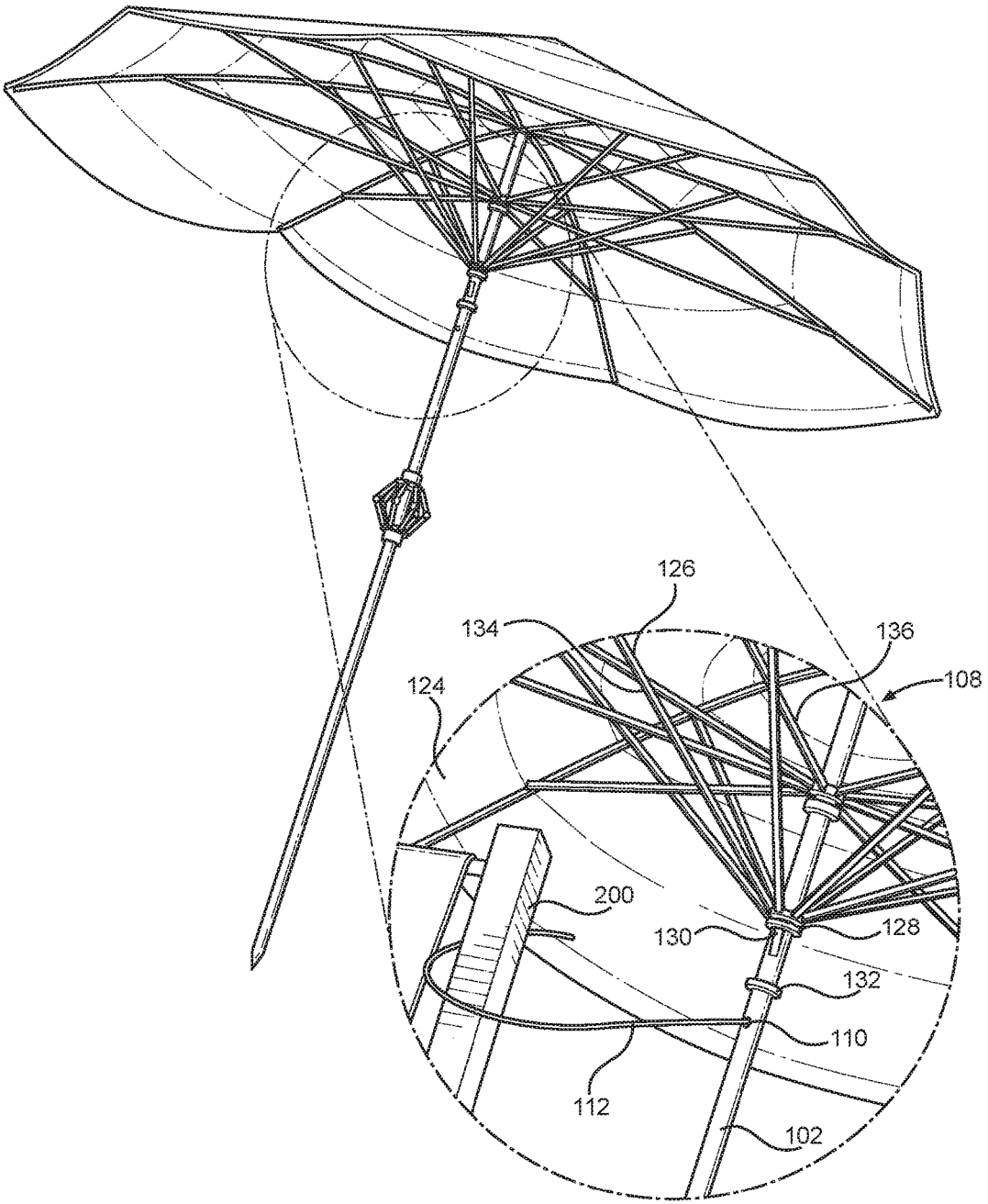
FIG. 2A shows a close-up view of the first end of the umbrella shaft assembly in an open position.
Figure 2B:
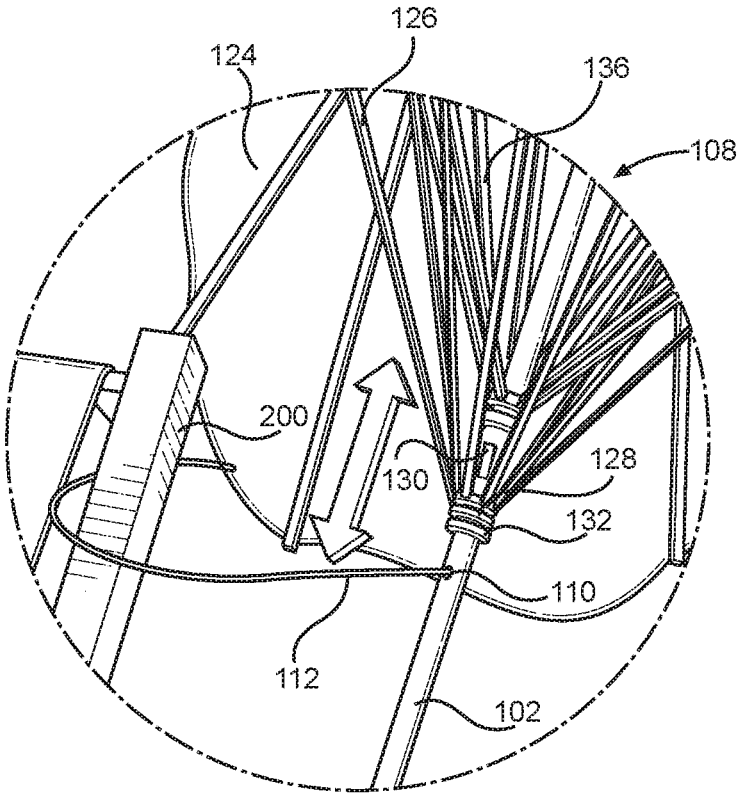
FIG. 2B shows a close-up view of the first end of the umbrella shaft assembly in a closed position.

Referring now to FIGS. 1 and 2, there is shown a perspective view of the umbrella shaft assembly secured to a chair and a close-up view of the first end of the umbrella shaft assembly, respectively. The umbrella shaft assembly 100 provides a large outdoor umbrella with integrated securing devices that ensures the umbrella will remain in place during wind, rain, and other weather conditions. The umbrella shaft assembly 100 comprises a conventional umbrella assembly 108 that is large enough to shield a person or persons from the elements encountered on a beach or outdoor patio. The umbrella shaft assembly 100 further comprises an elongated shaft 102 that has a first end 104 and a second end 106. Preferably, the shaft 102 comprises a circular shaped cross section. However, in alternate embodiments, the shaft 102 can comprise any suitable cross section, such as a square shape. In the illustrated embodiment, the elongated shaft 102 includes a point 122 on the second end 106 thereof, configured to be inserted into the ground.

The umbrella assembly 108 is disposed on the first end 104 of the elongated shaft 102. The umbrella assembly 108 comprises an umbrella covering 124 configured to shield a user located thereunder from the sun, rain, and the like. The umbrella covering 124 is supported by a first set 134 of a plurality of individual ribs 126 disposed therebeneath, wherein each rib 126 is secured between the umbrella covering 124 and a runner 128. The runner 128 comprises a member having an opening disposed in the center thereof, wherein the opening is configured to receive the elongated shaft 102 therethrough and further configured to allow the runner 128 to slide therealong. A second set 136 of a plurality of individual ribs 126 is secured between the umbrella covering 124 and the elongated shaft 102 above the runner 128, thereby securing the upper end of the umbrella covering 124 to the shaft 102.

In some embodiments, the umbrella assembly 108 further comprises a locking mechanism comprising a stopper 130 configured to allow the runner 128 to remain thereabove, which allows the umbrella assembly 108 to remain in an open configuration. The stopper 130 protrudes outwards from the elongated shaft 102 so as to allow the runner 128 to rest on the upper end thereof. In an open configuration, the umbrella covering 124 is extended outwards from the shaft 102. The stopper 130 is movable within the elongated shaft 102 and is configured to align flush therewith. Thus, the runner 128 can be moved below the stopper 130 in order to place the umbrella assembly 108 in a closed configuration. The locking mechanism further comprises a lip 132 disposed around the shaft 102 and below the stopper 130, so as to support the runner 128 thereon when the umbrella assembly is placed in a closed configuration, such that the umbrella covering 124 is disposed substantially against the shaft 102.

In some embodiments, the umbrella shaft assembly 100 further comprises a securing mechanism that allows the umbrella shaft assembly 100 to be removably secured to a chair 200. Preferably, the securing mechanism comprises a cord 112 and an aperture 110, wherein the aperture 110 is disposed on the elongated shaft 102 and configured for receiving the cord 112 therethrough. The cord 112 is inserted through the aperture 110 such that it can be removably attached to a beach chair 200 or other similar apparatus. The cord 112 can be composed of any suitable material, such as elastic. The cord 112 can be tied around a beach chair or other secure object in order to ensure that the umbrella shaft assembly 100 stays anchored and does not become displaced during windy conditions or the like. In some embodiments, a first end of the cord 112 includes a hook and a second end includes a clasp, wherein the cord 112 forms a loop configuration and the hook and clasp removably secure to one another.

Figure 3:
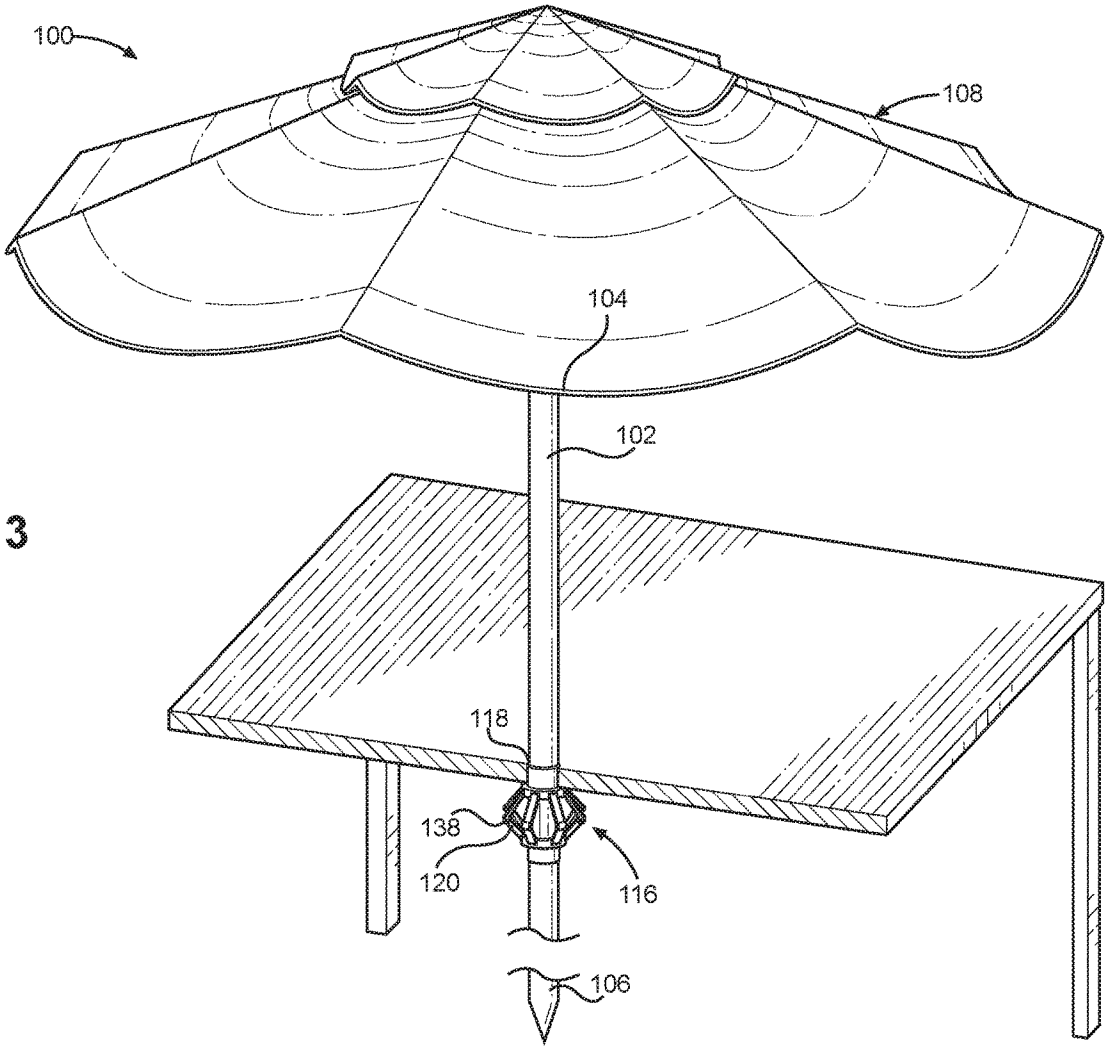
FIG. 3 shows a cross-sectional view of a table having the umbrella shaft assembly inserted therethrough.
Figure 4A:
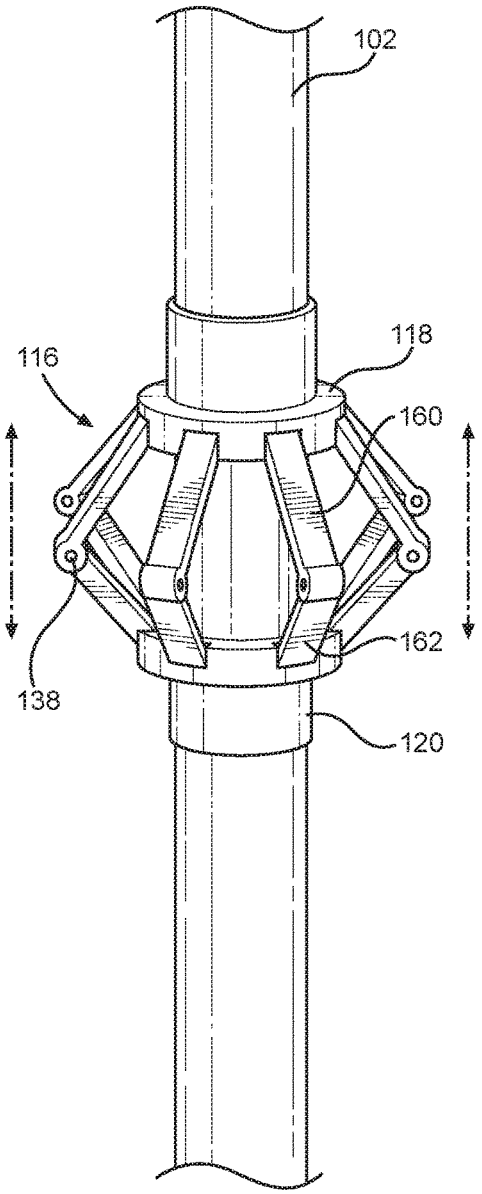
FIG. 4A shows a close-up view of the finger projections of the umbrella shaft assembly in a deployed position.
Figure 4B:
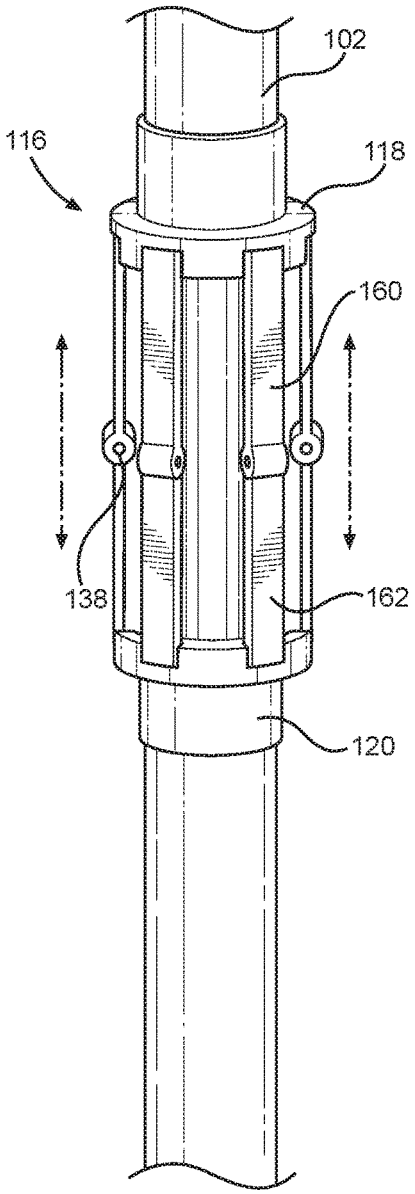
FIG. 4B shows a close-up view of the finger projections of the umbrella shaft assembly in a retracted position.
Figure 5A:
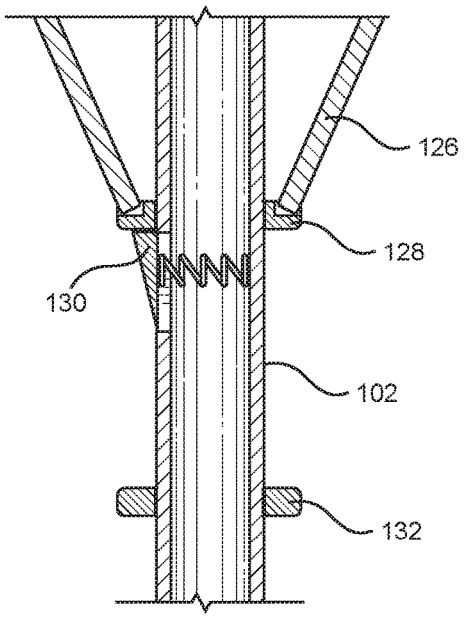
FIG. 5A shows a cross-sectional view of the stopper of the umbrella shaft assembly in an extended position.
Figure 5B:
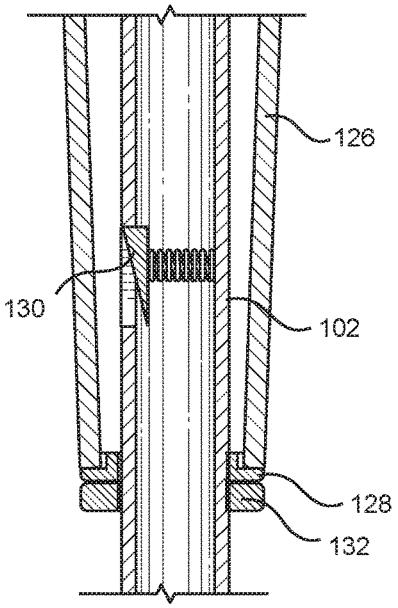
FIG. 5B shows a cross-sectional view of the stopper of the umbrella shaft assembly in an actuated position.

Referring now to FIGS. 3 and 4, there is shown a cross-sectional view of a table having the umbrella shaft assembly 100 inserted therethrough and a close-up view of the finger projections 116 of the umbrella shaft assembly 100, respectively. The umbrella shaft assembly 100 further comprises a plurality of hinged finger projections 116, each of which extend outwardly from the elongated shaft 102. The finger projections 116 are each attached to an upper member 118 and a lower member 120, wherein the members 118, 120 each comprise an opening disposed around the shaft 102. The lower member 120 is secured to the elongated shaft 102 and the upper member 118 is slidably secured to the elongated shaft 102 above the lower member 120.

Each finger projection 116 comprises a first leg 160 and a second leg 162, wherein the first leg 160 is secured to the upper member 118 and the second leg 162 is secured to the lower member 120. A finger projection 116 comprises a hinged or bent portion 138 disposed between the first and second legs 160, 162 thereof so as to allow each finger projection 116 to extend outward or retract inward toward the elongated shaft 102. In this way, the first leg and the second leg are configured to pivot symmetrically relative to each other about the hinge. In operation, the second end 106 of the shaft 102 of the umbrella shaft assembly 100 is placed within a hole of a table or within a similarly sized hole. Thereafter, the finger projections 116 can be deployed by sliding the upper member 118 downward. The fingers 116 are then extended outward, thereby providing a barrier that prevents the shaft 102 of the umbrella shaft assembly 100 from being lifted upward and out of the table hole. In other embodiments, the upper member 118 of each finger 116 is secured to the shaft 102 and the lower member 120 is slidably secured thereto.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An umbrella shaft assembly, comprising:

an elongated shaft including an umbrella assembly, the umbrella assembly including an umbrella covering positionable between an open and a closed configuration; and a plurality of finger projections disposed on the elongated shaft, each of the plurality of finger projections including a first leg, a second leg, a hinge, and a linear length;

the first leg attached to an upper member slidably disposed around the elongated shaft and terminating at the hinge;

the second leg attached to a lower member affixed to the elongated shaft and terminating at the hinge;

the hinge disposed at a center of the linear length of each of the plurality of finger projections, the center dividing each of the finger projections into the first leg and the second leg;

wherein the first leg is pivotally connected to the second leg about the hinge; and wherein the first leg and the second leg are configured to pivot symmetrically relative to each other about the hinge.

2. The umbrella shaft assembly of claim 1, wherein the first leg and the second leg are equal in length and symmetrical about the hinge.

3. The umbrella shaft assembly of claim 1, further comprising a runner slidably disposed along the elongated shaft.

4. The umbrella shaft assembly of claim 3, wherein the umbrella covering comprises a first plurality of ribs including a first end and a second end, the first end attached to a lower surface of the umbrella covering and the second end attached to the runner;

wherein the first plurality of ribs is slidable about the elongated shaft via the runner.

5. The umbrella shaft assembly of claim 4, wherein the umbrella covering comprises a second plurality of ribs including a first end and a second end, the first end attached to the lower surface of the umbrella covering and the second end attached to the elongated shaft between a first end of the elongated shaft and the runner;

wherein the second plurality of ribs secures the umbrella covering to the shaft.

6. The umbrella shaft assembly of claim 3, further comprising a locking mechanism including a stopper and a lip;

the stopper disposed along the elongated shaft, the stopper movable into and out of an interior of the elongated shaft, such that when the stopper is out of the elongated shaft the stopper protrudes outwardly relative to the elongated shaft, thereby allowing the runner to rest thereon and hold the umbrella covering in an open configuration, and when the stopper is in the elongated shaft, the runner can slide past the stopper, thereby allowing the umbrella covering to move into a closed configuration;

the lip disposed around the shaft and positioned below the stopper, the lip extending perpendicularly outwardly relative to the elongated shaft such that it may support the runner when the umbrella covering is in a closed configuration.

7. The umbrella shaft assembly of claim 1, further comprising an aperture disposed on said elongated shaft and configured to receive a cord therethrough.

8. A shaft assembly for an umbrella, comprising:

an elongated shaft including a plurality of finger projections, each of the plurality of finger projections including a first leg, a second leg, a hinge, and a linear length;

the first leg attached to an upper member slidably disposed around the elongated shaft and terminating at the hinge;

the second leg attached to a lower member affixed to the elongated shaft and terminating at the hinge;

the hinge disposed at a center of the linear length of each of the plurality of finger projections, the center dividing each of the finger projections into the first leg and the second leg;

wherein the first leg is pivotally connected to the second leg about the hinge;

wherein the first leg and the second leg are configured to pivot symmetrically relative to each other about the hinge;

wherein the first leg and the second leg are equal in length and symmetrical about the hinge.

9. The shaft assembly of claim 8, further comprising a runner slidably disposed along the elongated shaft.

10. The shaft assembly of claim 9, further comprising a locking mechanism including a stopper and a lip;

the stopper disposed along the elongated shaft, the stopper movable into and out of an interior of the elongated shaft, such that when the stopper is out of the elongated shaft the stopper protrudes outwardly relative to the elongated shaft, thereby allowing the runner to rest thereon and hold the umbrella covering in an open configuration, and when the stopper is in the elongated shaft, the runner can slide past the stopper, thereby allowing the umbrella covering to move into a closed configuration;

the lip disposed around the shaft and positioned below the stopper, the lip extending perpendicularly outwardly relative to the elongated shaft such that it may support the runner when the umbrella covering is in a closed configuration.

11. The shaft assembly of claim 8, further comprising an aperture disposed on said elongated shaft and configured to receive a cord therethrough.

* * * * *